US009416657B2

(12) United States Patent
Tao et al.

(10) Patent No.: US 9,416,657 B2
(45) Date of Patent: Aug. 16, 2016

(54) DUAL FLOWLINE TESTING TOOL WITH PRESSURE SELF-EQUALIZER

(71) Applicant: SCHLUMBERGER TECHNOLOGY CORPORATION, Sugar Land, TX (US)

(72) Inventors: Chen Tao, Sugar Land, TX (US); Pierre-Yves Corre, Eu (FR); Nathan Landsiedel, Fresno, TX (US); Sylvain Bedouet, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 167 days.

(21) Appl. No.: 14/078,879

(22) Filed: Nov. 13, 2013

(65) Prior Publication Data

US 2014/0157883 A1 Jun. 12, 2014

Related U.S. Application Data

(60) Provisional application No. 61/726,872, filed on Nov. 15, 2012.

(51) Int. Cl.
*E21B 49/10* (2006.01)
*E21B 49/08* (2006.01)

(52) U.S. Cl.
CPC ..... *E21B 49/10* (2013.01); *E21B 49/081* (2013.01)

(58) Field of Classification Search
CPC ..... E21B 49/10
USPC ..... 73/152.23, 152.24, 152.31
See application file for complete search history.

(56) References Cited

U.S. PATENT DOCUMENTS

| | | | | |
|---|---|---|---|---|
| 4,507,957 | A | 4/1985 | Montgomery et al. | |
| 7,114,385 | B2 | 10/2006 | Fisseler et al. | |
| 7,458,419 | B2 | 12/2008 | Nold, III et al. | |
| 7,584,786 | B2 | 9/2009 | Nold, III et al. | |
| 7,793,713 | B2 | 9/2010 | Nold, III et al. | |
| 8,042,611 | B2 * | 10/2011 | Briquet et al. | 166/242.6 |
| 8,210,260 | B2 * | 7/2012 | Milkovisch et al. | 166/264 |
| 8,215,389 | B2 | 7/2012 | Nold, III et al. | |
| 8,220,536 | B2 | 7/2012 | Tao et al. | |
| 8,561,686 | B2 | 10/2013 | Tao et al. | |

(Continued)

FOREIGN PATENT DOCUMENTS

| | | |
|---|---|---|
| WO | 2011080586 A2 | 7/2011 |
| WO | 2012088058 A2 | 6/2012 |

OTHER PUBLICATIONS

International Search Report & Written Opinion issued in PCT/US2013/070234 on Mar. 7, 2014; 10 pages.

*Primary Examiner* — John Fitzgerald
*Assistant Examiner* — Jean Morello
(74) *Attorney, Agent, or Firm* — Kenneth L. Kincaid

(57) ABSTRACT

Flowline pressure equalizer systems, methods and/or apparatuses for use on a downhole tool are provided. A pressure equalizer may be provided in communication with two flowlines. The pressure equalizer may use equalizing chambers and equalizing pistons to regulate pressure in one or both flowlines. Further, one or more flow routing modules may be interchangeable to further alter the flow scheme between the flowlines. Different plugs may house various flow routing configurations such that the plugs may be installed and/or removed in the tool string automatically or by a user.

10 Claims, 7 Drawing Sheets

(56) References Cited

U.S. PATENT DOCUMENTS

| | | | | |
|---|---|---|---|---|
| 2005/0161218 | A1 | 7/2005 | van Zuilekom et al. | |
| 2007/0151727 | A1 | 7/2007 | Tao et al. | |
| 2007/0187634 | A1* | 8/2007 | Sneh | 251/30.01 |
| 2007/0272415 | A1* | 11/2007 | Ratliff et al. | 166/368 |
| 2009/0301233 | A1 | 12/2009 | Irani et al. | |
| 2010/0071898 | A1* | 3/2010 | Corre et al. | 166/264 |
| 2010/0081543 | A1* | 4/2010 | Schmidt et al. | 477/120 |
| 2010/0243269 | A1* | 9/2010 | Solhaug et al. | 166/374 |
| 2011/0114310 | A1* | 5/2011 | Ross et al. | 166/250.17 |

* cited by examiner

DUAL FLOWLINE TESTING TOOL WITH PRESSURE SELF-EQUALIZER

CROSS-REFERENCE TO RELATED APPLICATIONS

The present disclosure claims the benefit of U.S. Provisional Patent Application 61/726,872, filed Nov. 15, 2012, the entirety of which is incorporated herein by reference.

FIELD OF THE INVENTION

Aspects generally relate to evaluation of a subterranean formation. More specifically, aspects relate to downhole formation fluid sampling techniques apparatus for accomplishing formation fluid sampling with an equalizer.

BACKGROUND INFORMATION

Underground formation testing is performed during drilling and geotechnical investigation of underground formations. Testing of such underground formations is important as the results of such examinations may determine, for example, if a driller proceeds with drilling and/or extraction. Since drilling operations are expensive, excessive drilling impacts the overall economic viability of drilling projects. There is a need, therefore, to minimize the amount of drilling and to obtain accurate information from the underground formations.

Different types of information may be obtained from the underground formations. One of the primary forms of information is obtained using actual samples of fluid from underneath the ground surface. Such samples, when they are obtained, are analyzed to determine constituents of the underground formation.

Determination of the underground fluid constituents is important in the exploration for trapped hydrocarbon reserves. Determination of oil, gas or mixtures of oil and gas are of importance in many areas of the world, and correct determination of the presence of the constituents is valuable.

Obtaining fluid samples from a formation requires a great deal of precision. This precise sampling is referred to as focused sampling. Focused sampling techniques are described in detail in U.S. Pat. No. 8,210,260 to Milkovisch et al. and U.S. Patent Publication No. 2010/0071898 to Corre et al., the contents of which are herein incorporated by reference. In focused sampling, fluid is pumped from a formation through a peripheral zone and/or a central zone of a wellbore wall. The fluid is drawn and/or pumped into two or more flowlines of a downhole tester. Oftentimes, the pumping pressure is desired to be adjusted at the peripheral or guard zone relative to the pumping pressure of the fluid at the central or sample zone. However, adjusting of pumping pressure results in increased complexity, weight and cost of the downhole tester. The increased weight and complexity are due to the existence of a second pump because each flowline is required to be coupled to a pump.

SUMMARY

The present summary should not be considered limiting and provides but one arrangement for accomplishing the aspects described. A tool, is described having a body configured to expand from a first outer diameter to a second outer diameter; at least one sample port in the body configured to accept a fluid in an environment; at least one guard port in the body configured to accept the fluid in the environment; at least one flow line configured to extend from each of the sample port and the guard port to transport fluid; and a pressure equalizer configured between at least two flowlines.

DETAILED DESCRIPTION

Figure 1:
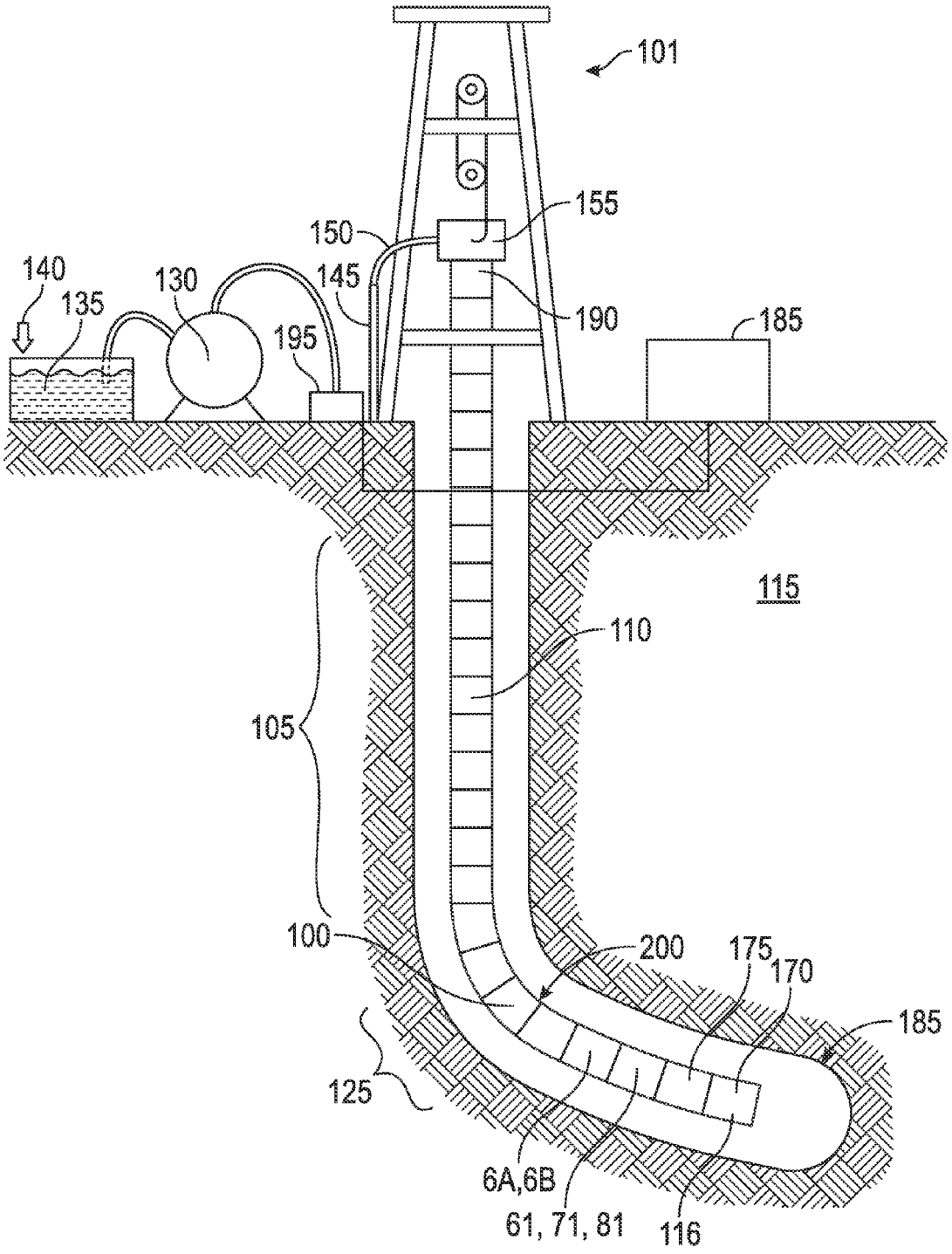
FIG. 1 shows a side view of a drill rig system that prepares a wellbore in a geotechnical subsurface environment.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The example pressure equalizer apparatuses, systems, and/or methods described herein may be used on a downhole tester, such as, for example, a packer, to sample fluids in a subterranean formation. More specifically, the example pressure equalizers described herein may regulate and/or adjust pressures in flowlines of a downhole tester by controlling the flow of fluid in at least one of the flowlines. After flowing from the pressure equalizer, the flow may be further diverted by a flow routing module with adjustable routing components.

The present disclosure illustrates an apparatus, a system, and/or a method for focused collection of formation fluid through two or more ports of a downhole tool. The downhole tool may be, for example, a packer. When sampling with a packer, the collected formation fluid may be conveyed along an outer layer of the packer to flowlines and then directed to a desired collection location.

The packer may be expandable across an expansion zone to collect formation fluids from a position along the expansion zone, i.e., between axial ends of the outer sealing layer. Formation fluid may be collected through one or more ports or drains having fluid openings in the packer for receiving formation fluid into an interior of the packer. The drains may be positioned at different radial and longitudinal distances. For example, separate drains may be disposed along the length of the packer to establish collection intervals or zones that enable focused sampling at a plurality of collecting intervals, e.g., two or three collecting intervals.

The collected formation fluid may be directed along flowlines having a sufficient inner diameter to transport the formation fluid. Separate flowlines may be connected to different drains to enable the collection of unique formation fluid samples. Different flowlines may serve different ports. For example, a sample port may be served by one flowline, and a guard port may be served by a separate flowline. Depending on the composition of the sampled fluid and conditions, the pressure in the flowlines may be desired to be regulated. A pressure equalizer may be provided in communication with the two flowlines. The pressure equalizer may use an equalizing chamber and an equalizing piston. Further, one or more pressure equalizers may be interchangeable to change the flow scheme between the flowlines. Different plugs may house various pressure equalizer configurations such that the plugs may be changed in the downhole tool by a technician or a user.

In accordance with the present disclosure, a wellsite with associated wellbore 110 and apparatus is described to exhibit a typical, but not limiting, environment in which an embodiment of the application may be installed. To that end, the apparatus at the wellsite may be altered, as necessary, due to field considerations. The apparatus may be installed using various techniques described hereinafter.

Referring now to the drawings wherein like numerals refer to like parts, FIG. 1 shows one embodiment of a rig 101 as deployed in the wellbore 110. The rig/well system 101 has a conveyance 105 employed to deliver at least one packer 200 (hereinafter referred to as "packer" or "focused sampling module") into the wellbore 110. In many applications, the packer 200 is used on a modular dynamics formation tester (MDT) tool deployed by the conveyance 105 (hereinafter referred to as "conveyance" or "tool string") in the form of a wireline. However, the conveyance 105 may have other forms, including tubing strings, such as a coiled tubing, tool strings, production tubing, casing or other types of conveyances depending on the required application. In the embodiment illustrated in FIG. 1, the packer 200 is an inflatable packer or an extendable packer that may be used to collect formation fluids from a surrounding formation 115. The packer 200 is selectively expanded in a radially outward direction to seal across an expansion zone. For example, the packer 200 may be inflated by fluid, such as wellbore fluid, hydraulic fluid or other fluid. When the packer 200 is expanded to seal against the wellbore 110, formation fluids may flow into the packer 200. The formation fluids may then be directed to a tool flow line and produced to a collection location, such as a location at a well site surface.

As shown in FIG. 1, the conveyance 105 may extend from a rig/well system 101 into a zone of the formation 115. In an embodiment, the packer 200 may be part of a plurality of tools 125, such as a plurality of tools forming a modular dynamics formation tester. The tools 125 may collect the formation fluid, test properties of the formation fluid, obtain measurements of the wellbore, formation about the wellbore or the conveyance 105 or perform other operations as will be appreciated by those having ordinary skill in the art. The tools 125 may be measuring while drilling ("MWD") and/or logging while drilling ("LWD") tools, for example such as shown by numerals 6*a*, 6*b*. In an embodiment, the downhole tools 6*a* and 6*b* may be a formation pressure MWD tool.

In an embodiment, the tools 125 may include LWD tools having a thick walled housing, commonly referred to as a drill collar and may include one or more of a number of logging devices. The LWD tools may measure, process, and/or store information therein, as well as communicate with equipment disposed at the surface of the well site. As another example, the MWD tools may include one or more of the following measuring components: a modulator, a weight on bit measuring device, a torque measuring device, a vibration measuring device, a shock measuring device, a stick slip measuring device, a direction measuring device, an inclination measuring device and\or any other device. As yet another example, the tools 125 may include a formation capture device 170, a gamma ray measurement device 175 and formation fluid sampling tools 61, 71, 81 which may include a formation pressure measurement device 6*a* and/or 6*b*. The signals may be transmitted toward the surface of the earth along the conveyance 105.

Measurements obtained or collected may be transmitted via a telemetry system to a computing system 185 for analysis. The telemetry system may include wireline telemetry, wired drill pipe telemetry, mud pulse telemetry, fiber optic telemetry, acoustic telemetry, electromagnetic telemetry or any other form of telemetering data from a first location to a second location. The computing system 185 is configurable to store or access a plurality of models, such as a reservoir model, a fluid analysis model, a fluid analysis mapping function.

The rig 101 or similar functioning devices may be used to move the conveyance 105. Several of the components disposed proximate to the rig 101 may be used to operate components of the overall system. For example, a drill bit 116 may be used to increase the depth of the wellbore. In an embodiment where the conveyance 105 is a wireline, the drill bit 116 may not be present or may be replaced by another tool. A pump 130 may be used to lift drilling mud 135 from a tank 140 or pits. The mud 135 may be discharged under pressure through a standpipe 145, a flexible conduit 150 or hose, through a top drive 155 and into an interior passage inside the conveyance 105. The mud 135, which may be water-based or oil-based, exits the conveyance 105 through courses or nozzles (not shown) in the drill bit 116. The mud 135 may cool and/or lubricate the drill bit 116 and lift drill cuttings generated by the drill bit 116 to the surface of the earth through an annular arrangement.

After the wellbore 110 has been drilled to a selected depth, the tools 125 may be positioned at the lower end of the conveyance 105 if not previously installed. The tools 125 may be coupled to an adapter sub (not shown) at the end of the conveyance 105 and may be moved through, for example in the illustrated embodiment, a highly inclined portion 165 of the wellbore 110.

During well logging operations, the pump 130 may provide fluid flow to operate one or more turbines in the tools 125 to provide power to operate certain devices in the tools 125. When tripping in or out of the wellbore 110, the pumps 130 may be turned on and off to provide fluid flow. As a result, power may be provided to the tools 125 in other ways. For example, batteries may be used to provide power to the tools 125. In one embodiment, the batteries may be rechargeable batteries and may be recharged by turbines during fluid flow. The batteries may be positioned within the housing of one or more of the tools 125. Other manners of powering the tools 125 may be used including, but not limited to, one-time power use batteries.

An apparatus and system for communicating from the conveyance 105 to the surface computer 185 or other component configured to receive, analyze, and/or transmit data may include a second adapter sub 190 that may be coupled between an end of the conveyance 105 and the top drive 155. The top drive 155 may be used to provide a communication channel with a receiving unit 195 for signals received from the tools 125. The receiving unit 195 may be coupled to the surface computer 185 to provide a data path therebetween that may be a bidirectional data path.

The conveyance 105 may alternatively be connected to a rotary table (not shown), via a kelly, and may suspend from a traveling block or hook (not shown) and a rotary swivel (not shown). The rotary swivel may be suspended from the drilling rig 101 through the hook, and the kelly may be connected to the rotary swivel such that the kelly may rotate with respect to the rotary swivel. The kelly may be any mast that has a set of polygonal connections or splines on the outer surface type that mate to a kelly bushing such that actuation of the rotary table may rotate the kelly. An upper end of the conveyance 105 may be connected to the kelly, such as by threadingly reconnecting the tool string 105 to the kelly. The rotary table may rotate the kelly to rotate the tool string 105 connected thereto.

Figure 2:
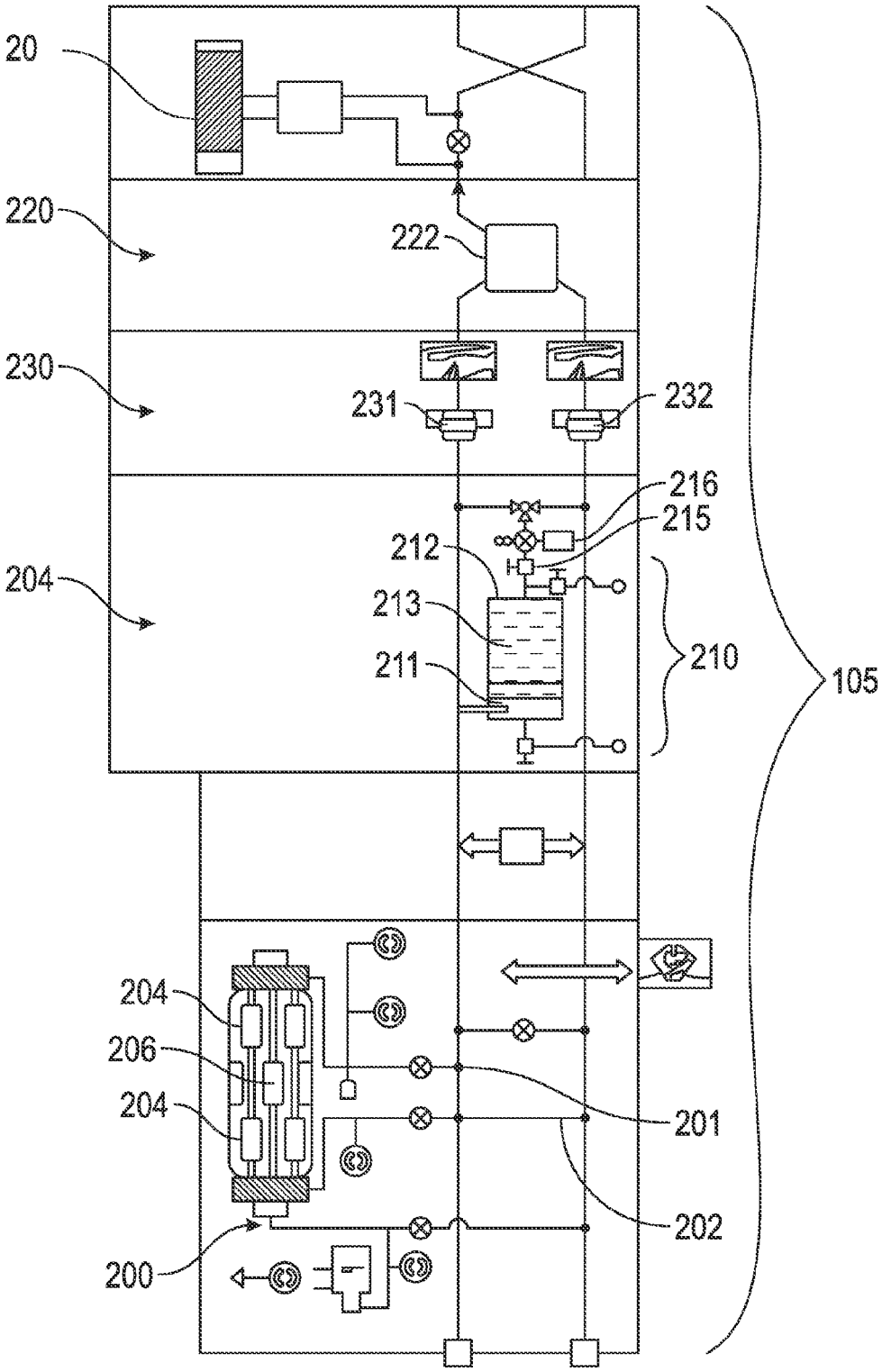
FIG. 2 shows a schematic view of a downhole tool that may be used in the geotechnical environment to carry out embodiments of the present disclosure.

FIG. 2 shows a schematic diagram view of a tool string 105 that may be used in the geotechnical environment to carry out embodiments of the present disclosure. For example, the packer 200 may be deployed into a wellbore 110 for other uses. The packer 200 may be used to fluidly isolate one portion of a wellbore 110 from another portion of a wellbore 110. The packer 200 is conveyed to a desired downhole location and, in the non-limiting embodiment provided, inflated or expanded to provide a seal between the packer 200 and the well 100. For example, the packer system may prevent fluid communication from two portions of the wellbore 110 by expanding or inflating circumferentially to abut the wellbore 110.

The packer 200 may have one or more ports or sampling drains 204, 206 (the terms "drains" or "ports" are used herein interchangeably, and no inference should be drawn from use of one term without the other) for receiving fluid from the formation or the wellbore into the packer 200. In an embodiment, the packer 200 has one or more guard ports 204 located longitudinally from one or more sample ports 206. In the illustrated embodiment, the guard ports 204 are illustrated at a closer longitudinal distance from ends of the packer 200 than a longitudinal distance of the one or more sample ports 206 to the ends of the packer system 200. The ports 204, 206 may be located at distinct radial positions about the packer system 200 such that the ports 204, 206 contact different radial positions of the wellbore.

The ports 204, 206 may be embedded radially into a sealing element of an outer layer of the packer 200. By way of example, the sealing element may be cylindrical and formed of an elastomeric material selected for hydrocarbon based applications, such as nitrile rubber (NBR), hydrogenated nitrile butadiene rubber (HNBR), and fluorocarbon rubber (FKM). The packer 200 may be expanded or inflated, such as by the use of wellbore fluid, hydraulic fluid, mechanical arrangement or otherwise positioned such that one or more of the sample ports 206 and one or more of the guard ports 204 may abut the walls of the formation 115 to be sampled. The packer 200 may be expanded or inflated from a first position to a second position such that the outer diameter of the packer 200 is greater at the second position than the first position. In an embodiment, the second position may be the position in which the ports 204, 206 abut the formation, and the first position may be an unexpanded or deflated position. The packer 200 may move to a plurality of positions between the first position and the second position. The packer 200 may expand in the relative areas around the one or more guard ports 204 and the one or more sample ports 206. A tight seal may be achieved between the exterior of the packer 200 and the wellbore, a casing pipe or other substance external to the packer 200.

Operationally, the packer 200 is positioned within the wellbore 110 to a sampling location. The packer 200 is inflated or expanded to the formation through the expansion of the body of the packer 200 until the packer 200 abuts the formation 115. A pump 208 may be utilized to draw fluid from the ports 204, 206 and/or to transport fluid within or out of the packer 200. Flowlines 201, 202 may transfer the fluid drawn from the drains 204, 206 to other portions of the packer 200 and/or the downhole tool. The pump 208 may be incorporated into the packer 200, may be external to the packer 200 and/or may be incorporated into each of the individual drains 204, 206. The fluid removed through the sample drain 206 and/or guard drains 204 may then be transported through the packer 200 to a downhole tool, such as, for example, the tools 125 shown in FIG. 1.

The tool string may be configured in "reverse low shock" mode with a single pump 208 pumping fluid from a focused sampling module. The focused sampling module may be a single packer module as illustrated in FIG. 2. To achieve efficient separation of mud filtrate from formation fluid in respectively the guard ports 204 and the sample ports 206, the pressure at the guard ports 204 may be less than or equal to the pressure in the sample ports 206. While the pressures in the flowlines 201, 202 may be similar in and/or near the flow routing module 220, the pressure levels are not guaranteed to be the same at the guard ports 204 and the sample ports 206. For example, differences in flow rates and/or viscosities of the fluids flowing in the flowlines 201, 202 may cause pressure drops along the flowlines 201, 202. Moreover, during sampling, the pressure may be higher at the guard port 204 than at the sample port 206. In alternative configurations, alternative focusing sampling tools may be used, including a focused probe or quad packer configured to interface with the aforementioned systems and components.

To regulate pressures at the guard ports 204 and the sample ports 206, a pressure equalizer 210 may be provided between the two flowlines 201, 202. The pressure equalizer 210 may be closer to the focused sampling module 200 than a merging point 222 of the flowlines 201, 202 in a flow routing module 220. For example, the pressure equalizer 210 may be implemented in a field joint between the focused sampling module 200 and the next module, such as shown in FIG. 2. However, the pressure equalizer 210 may also be implemented as part of the focused sampling module 200, a multi-sample chamber module 240, and/or in other locations in the conveyance 105. The next module, may be, for example, a fluid analyzer module 230 for measuring properties of formation fluid drawn into the flowlines 201, 202. The fluid analyzer module 230 may have a first optical fluid analyzer 231 and a second optical fluid analyzer 232. In an alternative configuration, the pressure equalizer 210 may be an active flow restrictor, such as a throttling valve.

The first flowline 201 may be in fluid communication with a first intake valve 211 of an equalizing chamber 213 of the fluid pressure equalizer 210. The second flowline 202 may be in fluid communication with a second intake valve 212 of the equalizing chamber 213. The second flowline 202 may have a pilot relief valve 215 disposed on the second flowline 202 before the second intake valve 212 of the equalizing chamber 213. A pump 216 may be in communication with the second intake 212 of the equalizing chamber 213. The pump 216 may be configured to pressurize the equalizing chamber 213 by pumping fluid through the pilot relief valve 215.

Figure 3:
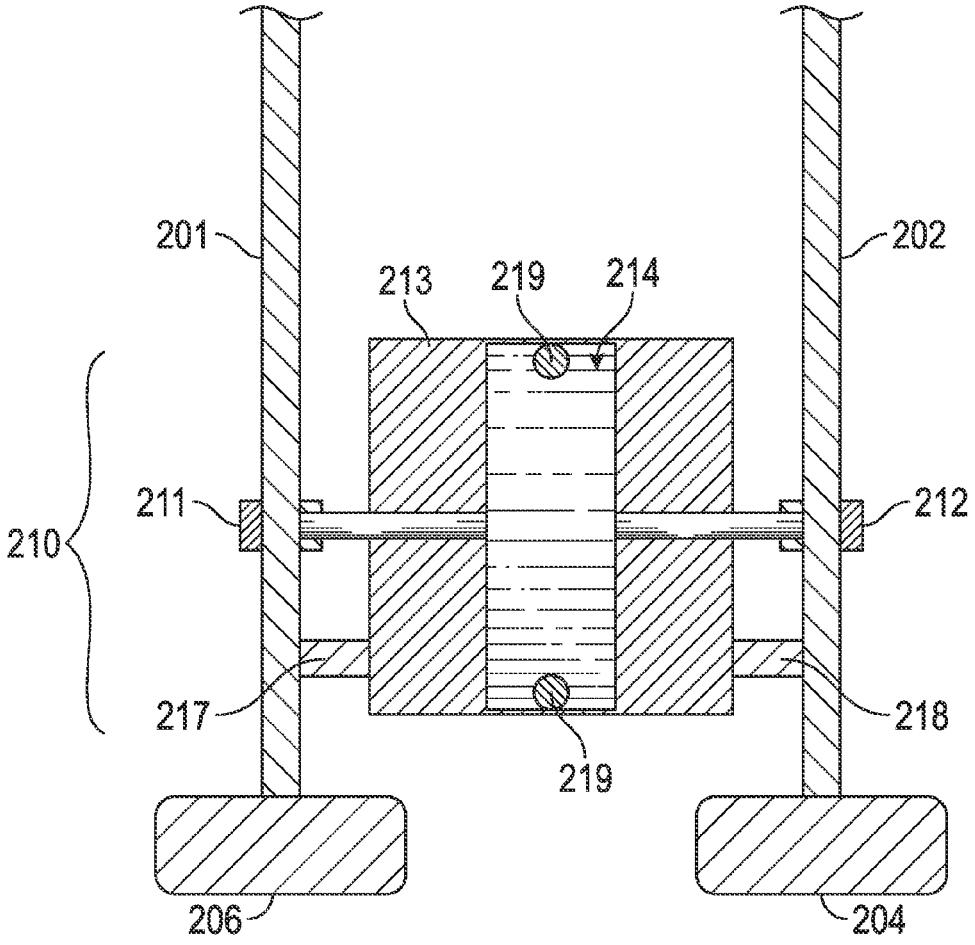
FIG. 3 shows a cross sectional diagrammatic view of a pressure equalizer between two flowlines in accordance with one or more aspects of the present disclosure.

FIG. 3 shows a cross-sectional diagram of the pressure equalizer module 210 between the flowlines 201, 202 in accordance with one or more aspects of the present disclosure. The first flowline 201 may be in communication with one or more of the sample ports 206 of the focused sampling module 200. The second flowline 202 may be in communication with one or more of the guard ports 204 of the focused sampling module 200. The pressure equalizer 210 may have an actuator. The position of the pressure equalizer 210 is contingent on the pressures in the guard flowline 202 and the sample flowlines 201. The actuator may be a piston 214, a diaphragm (not shown), or any other pressure induced mechanism. In the example shown in FIG. 2, the actuator is an equalizing piston 214 sized to slide in the equalizing chamber 213. The equalizing piston 214 may have an o-ring 219 disposed around a circumference thereof.

The equalizing chamber 213 may have two pressure passage holes 217, 218. Each of the two pressure passage holes 217, 218 connect one of the flowlines 201, 202 to the equalizing chamber 213. The pressure equalizer 210 may also have at least one intake valve that may progressively obstruct at least one of the sample flowline 201 or the guard flowline 202, or, as shown in FIG. 2, both of the flowlines 201, 202. The intake valves 211, 212 may be, for example, poppet valves, globe valves, butterfly valves or any other type of valve which may be known to one of ordinary skill in the art. The valves 211, 212 may be located downstream of the pressure passage holes 217, 218.

The piston 214 may be displaced based on the comparative pressure in the flowlines 201, 202. For example, if the pressure in the guard flowline 202 is larger than the pressure in the sample flowline 201, the equalizing piston 214 is biased toward the sample flowline 201 thereby closing the valve 211 disposed on the sample flowline 201, and/or opening the valve 212 disposed on the guard flowline 202. As a result, the flow rate in the sample flowline 201 may decrease, or the flow rate in the guard flowline 202 may increase, or both. When the flow rate in the sample flowline 201 decreases, the pressure at the port 206 increases towards the formation pressure. When the flow rate in the guard flowline 202 increases, the pressure in the sample flowline 201 decreases below the formation pressure. Thus, the piston 214 may stabilize at a position that ensures the same pressure level in both flowlines 201, 202.

Figure 4:
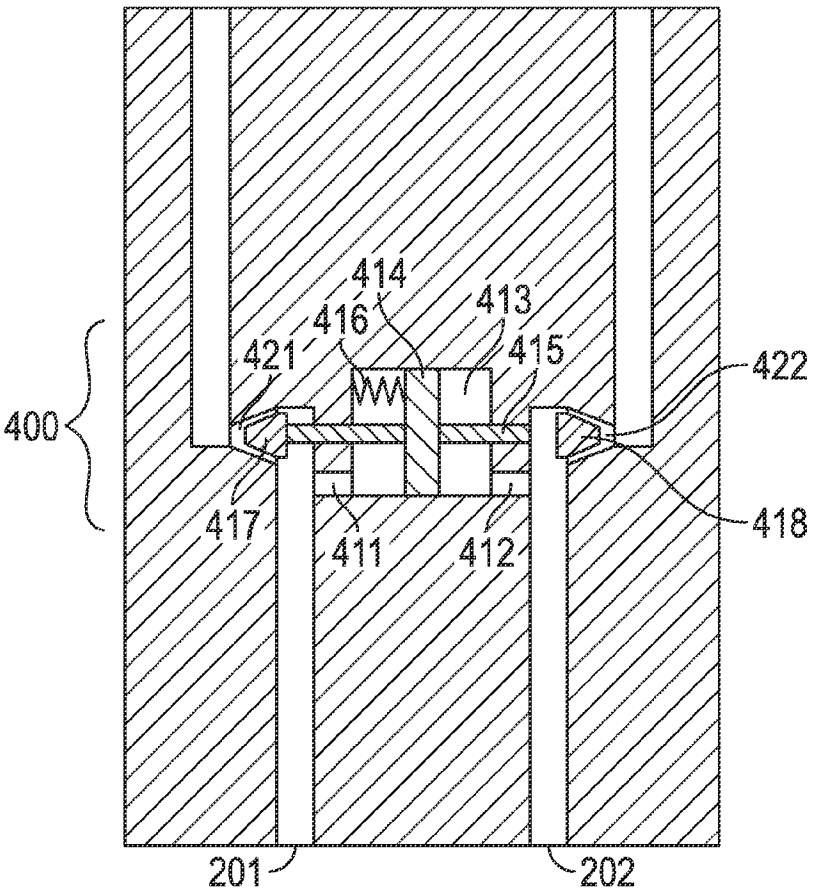

FIG. 4 shows a cross-sectional diagram of another pressure equalizer 400 between the flowlines 201, 202 in accordance with one or more aspects of the present disclosure that may be used. As illustrated, the pressure equalizer 400 has an equalizing chamber 413 and an equalizing piston 414. The flowlines 201, 202 have a corresponding intake 411, 412 into the equalizing chamber 413. The piston 414 may be affixed to a reciprocating rod 415 with a valve and/or sealing mechanism disposed on each end thereof. In the example shown, male cone valve plugs 417, 418 may be disposed on the ends of the rod 415. The male cone valve plugs 417, 418 may be associated with corresponding female cone valve inlets 421, 422. Thus, when the male cone plugs 417, 418 are abutted to the corresponding female inlets 421, 422, the corresponding flowlines 201, 202 become obstructed. The equalizing piston 414 may be biased by a spring 416 toward restricting the sample flowline 201 and/or opening the guard flowline 202. The bias may also be provided by a pressurized chamber, and/or any other biasing mechanism that may be used to apply a force on the equalizing piston 414 when the piston 414 is in a central/resting position as shown. Thus, the piston 414 of the equalizer 400 shown may stabilize in a position that ensures that the pressure in the sample flowline 201 is higher than the pressure in the guard flowline 202. The equalizer 400 may be disposed in the tool string 105 further away from the focused sampling module 200 and may still ensure that the pressure at the guard ports 204 is less than or equal to the pressure at the sample ports 206.

Figure 5:
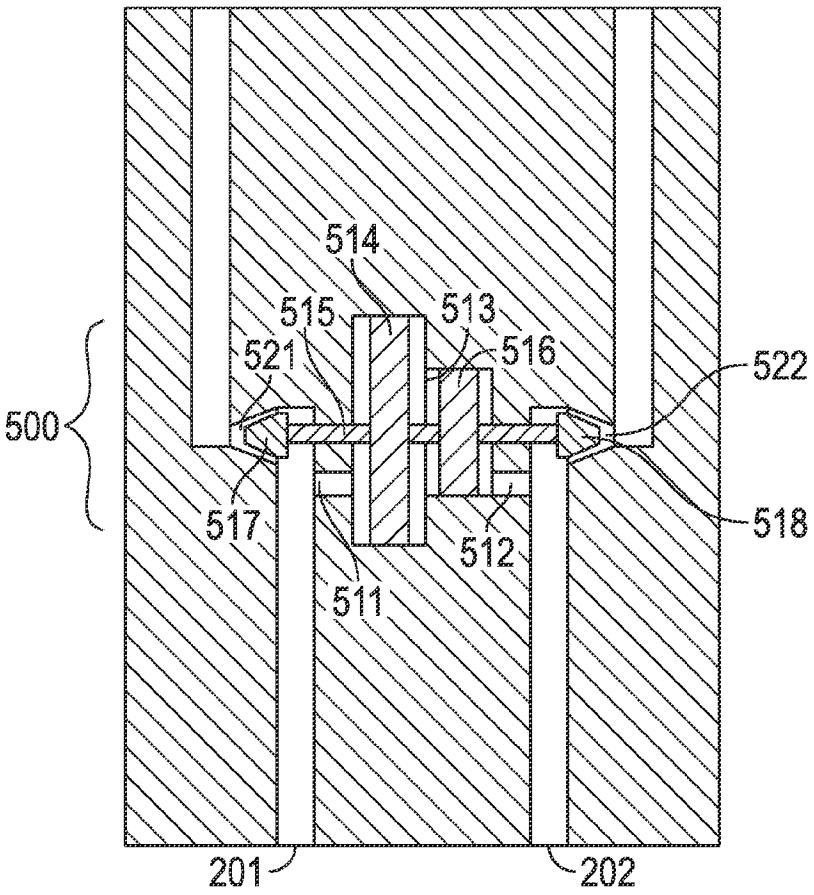
FIGS. 4 and 5 show cross sectional diagrams of pressure equalizers between two flowlines in accordance with one or more aspects of the present disclosure.

FIG. 5 shows a cross sectional diagram of yet another pressure equalizer 500 between the flowlines 201, 202 in accordance with one or more aspects of the present disclosure. The equalizer 500 is biased toward restricting the sample flowline 201 and/or opening the guard flowline 202. The bias is provided by stepped pistons 514, 516 disposed in an equalizing chamber 513. The first piston 514 on the side of the sample flowline 201 has a larger surface area than the second piston 516 on the side of the guard flowline 202. The arrangement of the pistons 514, 516 may also be reversed depending on the application. The flowlines have respective corresponding intakes 511 and 512.

The pistons 514, 516 are affixed on a reciprocating rod 515 with cone valve plugs 517, 518 on each end thereof. The cone valve plugs 517, 518 are insertable into corresponding female valve inlets 521, 522 to restrict flow in the corresponding flowlines 201, 202. The equalizing chamber 513 has a first intake 211 and a second intake 212 which correspond to the first flowline 201 and the second flowline 202, respectively.

Figure 7:
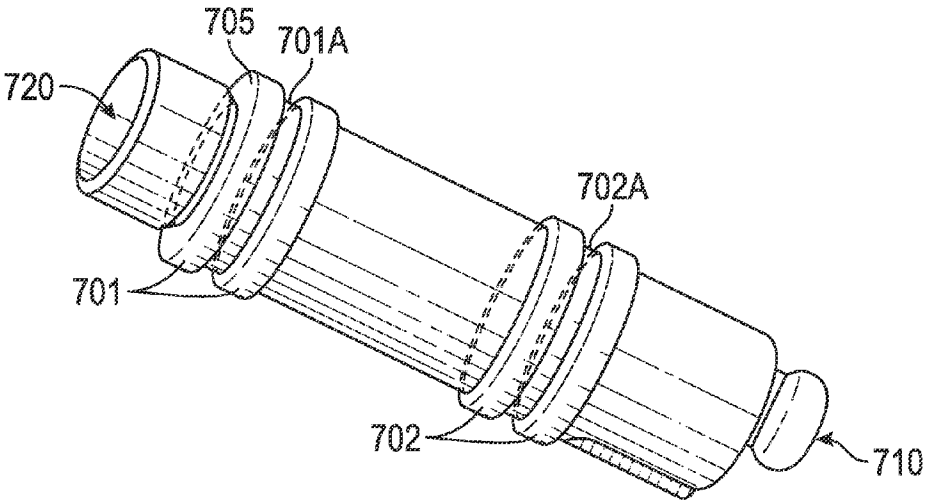
FIG. 7 shows a perspective view of a valve plug that may be used on the interchangeable flow routing valve system of FIG. 6.
Figure 6:
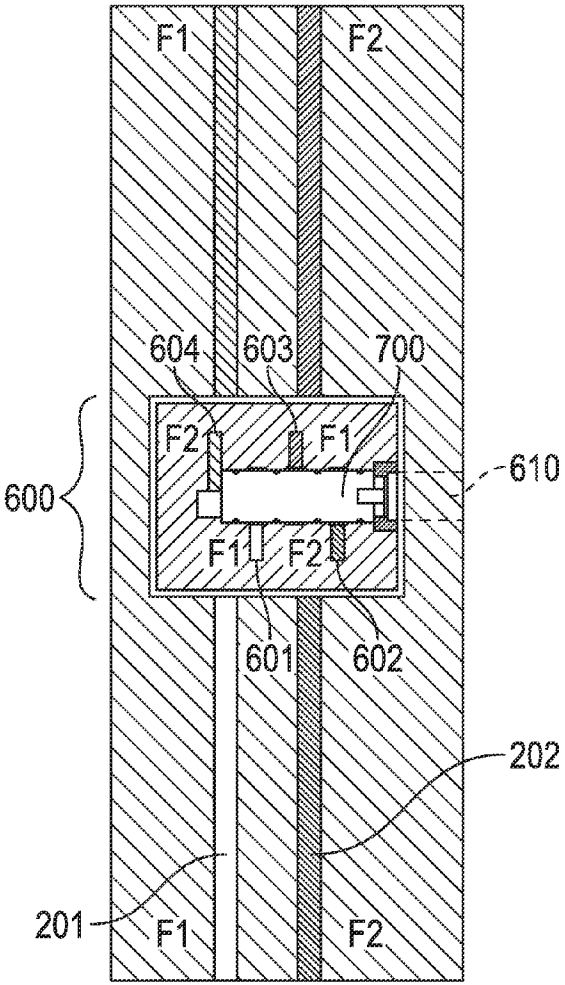
FIG. 6 shows a schematic view of an interchangeable flow routing valve module between two flowlines in accordance with one or more aspects of the present disclosure.

FIG. 6 shows a schematic view of an interchangeable flow routing valve module 600 between the flowlines 201, 202 in accordance with one or more aspects of the present disclosure. The flow routing module 600 may be used as the flow routing module 220 of the tool string 105 shown in FIG. 2. In alternative configurations, the flow routing module 600 may be a flow routing valve incorporated into a tool in the drillstring. The flow routing module 600 may have a cavity 610 through which a flow routing plug 700 may be inserted. FIG. 7 shows a perspective view of the plug 700 that may be used on the flow routing module 600 of FIG. 6. The plug 700 may have an exterior shape that is adaptable to conform to the cavity 610 of the flow routing module 600. The cavity 610 has intakes 601, 602 and outflows 603, 604 for the flowlines 201, 202. The plug 700, when inserted, routes the flow through the flowlines 201, 202. The plug 700 may be shaped such that the plug 700 may be plugged into place on the tool string 105. Multiple ones of the plugs 700 are interchangeable such that different ones of the plugs 700 may be inserted and/or removed from the module 600 with relative ease. The changing of the plugs 700 may be carried out automatically or manually by a user.

Multiple ones of the plugs 700 may be provided having different exterior shapes and/or interior configurations which correspond to different flow routing configurations. Grooves 701, 702 may be disposed about the valve for routing the flow. The grooves 701, 702 essentially form canals 701A, 702A through which the fluid flow is routed. The fluid is restricted to flowing through the canals 701A, 702A due to the plug 700 being flush within the cavity 610. O-rings 705 or rubber may be disposed about the grooves 701, 702 to prevent leakage of fluid. The interior surface of the cavity 610 is abutted by the raised grooves 701, 702 to restrict the movement of fluid. Therefore, in the exterior configuration shown in FIG. 7, the plug 700 restricts the flow from the flowline 201 to continue from the intake 601 through the outflow 604. Likewise, the grooves 702 rout the flow from the flowline 202 to continue from the intake 602 through the outflow 603. Thus, the example plug 700 shown diverts the flow from the flowline 201 to the flowline 202, and the flow from the flowline 202 to the flowline 201. It should be noted that, in the example shown, the intake 601 is the inflow from the flowline 201, and the outflow 603 is the outflow to the flowline 201. Likewise, the intake 602 is the inflow from flowline two 202, and outflow 604 is the outflow to the flowline 202. The plug 700 may also divert flow through an interior (not shown) thereof. Pipes and/or passages (not shown) may route the incoming flow.

Referring still to FIG. 7, an adapter port 710 may extend from the plug 700. The port 710 may be used to attach a resistor or other identifying pin-connector to the plug 700.

For example, the port 710 may have a resistor of a specific resistance such that measurement of the resistance identifies the flow routing configuration of the plug 700. When installed in the flow routing module 600, the port 710 may be connected to a resistance measuring device (not shown). The resistance measuring device may interpret the resistance measured, identify the plug configuration and/or relay the information to a user. Moreover, a symbol 720 may be disposed on the exterior of the plug 700 for purposes of identifying the flow regime.

Figure 8A:
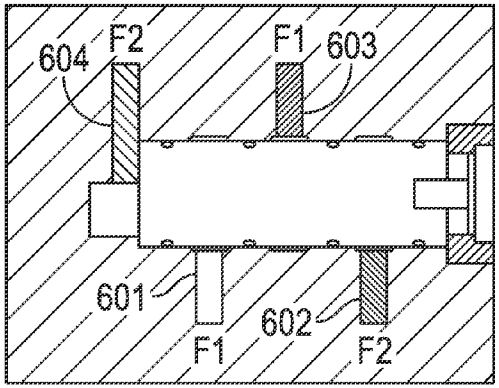
FIGS. 8A, 8B, 9A, 9B, 10A, 10B, 11A, 11B, 12A, 12B, 13A, 13B, 14A, 14B, 15A and 15B show schematic views of various flow routing configurations that may be employed by the flow routing module and plug of FIGS. 6 and 7.
Figure 8B:
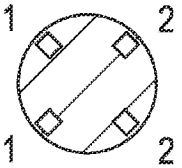
Figure 9A:
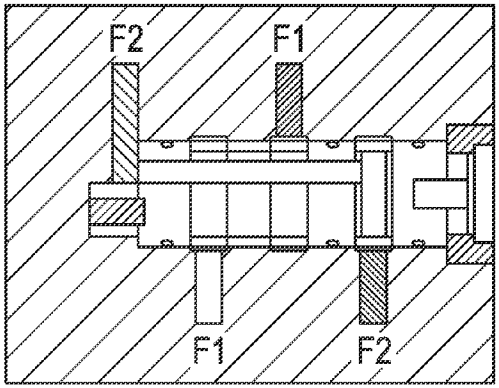
Figure 9B:
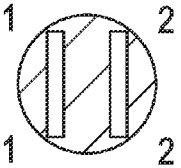
Figure 10A:
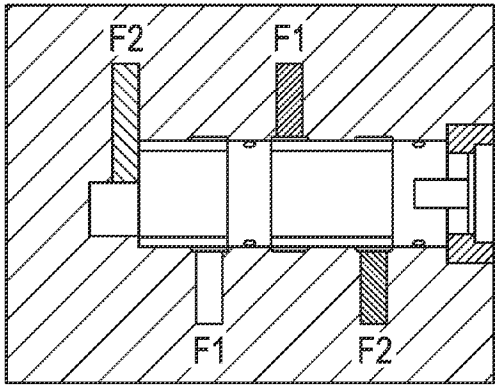
Figure 10B:
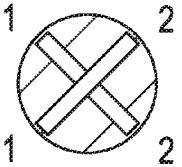
Figure 11A:
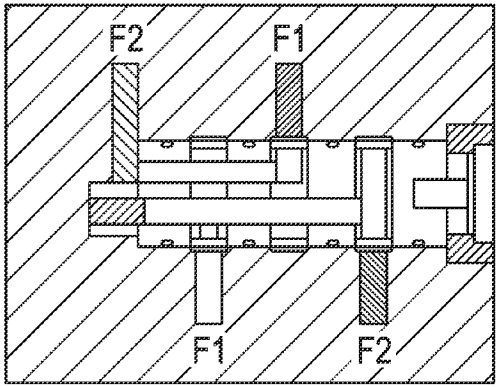
Figure 11B:
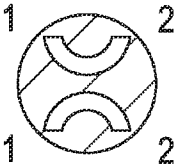
Figure 12A:
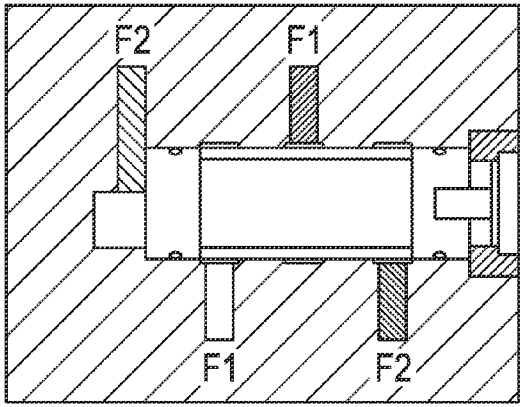
Figure 12B:
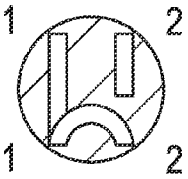
Figure 13A:
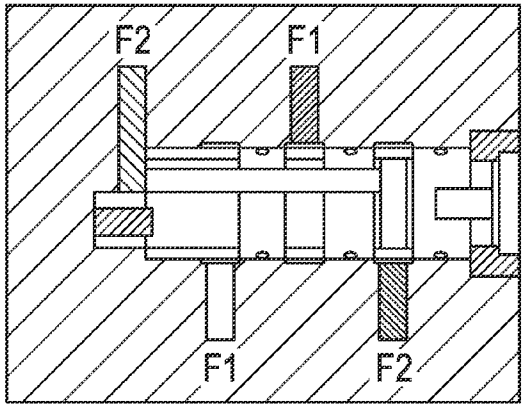
Figure 13B:
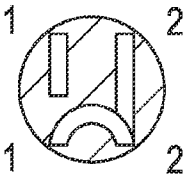
Figure 14A:
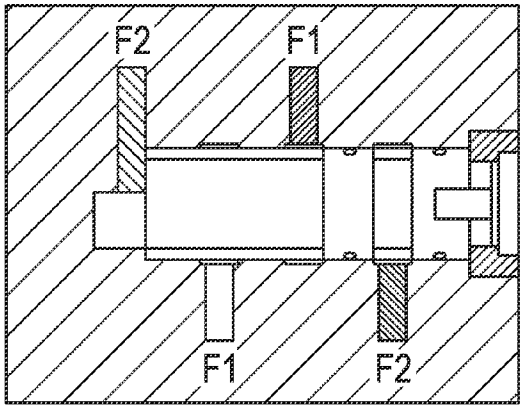
Figure 14B:
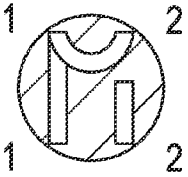
Figure 15A:
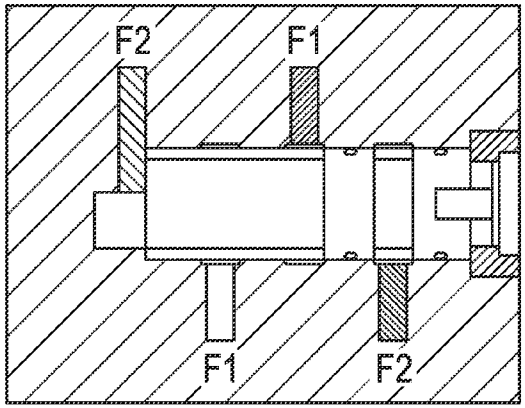
Figure 15B:
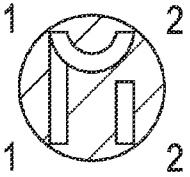

FIGS. 8A, 8B, 9A, 9B, 10A, 10B, 11A, 11B, 12A, 12B, 13A, 13B, 14A, 14B, 15A and 15B show schematic views of various flow routing configurations that may be employed by the flow routing module and plug of FIGS. 6 and 7. Each plug may have the two inlets 601, 602 for inflow from the flowlines 201, 202, respectively. Likewise, each plug may have the two outlets 603, 604 for outflow to the flowlines 201, 202. Each plug of FIGS. 8A through 15A has a different flow routing configuration as indicated by corresponding FIGS. 8B through 15B, respectively. For example, FIG. 10A shows a criss-crossing configuration by which the inflow from the guard flowline 202 is routed to the sample flowline 201, and the inflow from the sample flowline 201 is routed to the guard flowline 202. FIGS. 8A and 8B show a separated configuration in which the flowlines 201, 202 are closed. FIGS. 9A and 9B show a straight flow configuration in which the flows in the flowlines 201, 202 are kept segregated. FIGS. 11A and 11B show a return flow configuration in which the flow from the flowline 201 is returned via the flowline 202. FIGS. 12A, 12B, 13A, 13B, 14A, 14B, 15A and 15B show a plurality of configurations in which two flowlines are co-mingled into a single flowline.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures.

What is claimed is:

1. A downhole tool, comprising:

a body configured to expand from a first outer diameter to a second outer diameter;

at least one sample port in the body configured to accept a fluid in wellbore environment;

at least one guard port in the body configured to accept the fluid in the wellbore environment;

a first flowline coupled to the at least one sample port and configured to transport fluid from the at least one sample port;

a second flowline coupled to the at least one guard port and configured to transport fluid from the at least one guard port; and a pressure equalizer configured between the first and second flowlines, wherein the pressure equalizer comprises:

an equalizing chamber;

an actuator disposed in the equalizing chamber;

a first pressure passage hole configured to couple the first flowline to a first side of the equalizing chamber;

a second pressure passage hole configured to couple the second flowline to a second side of the equalizing chamber.

2. The downhole tool according to claim 1, wherein the pressure equalizer is positioned at a field joint.

3. The downhole tool according to claim 1, wherein the actuator is a piston.

4. The downhole tool according to claim 1, wherein the actuator is a diaphragm.

5. The downhole tool according to claim 1, wherein the actuator is configured to move within the equalizing chamber of the pressure equalizer such that a first flowline pressure is approximately the same as a second flowline pressure.

6. The downhole tool according to claim 1, wherein the pressure equalizer comprises:

a first valve disposed in the first flowline downstream of the first pressure passage hole, wherein the pressure equalizer is configured to at least partially close the first valve if a second flowline pressure is larger than a first flowline pressure; and a second valve disposed in the second flowline downstream of the second pressure passage hole, wherein the pressure equalizer is configured to at least partially close the second valve if the first flowline pressure is larger than the second flowline pressure.

7. The downhole tool according to claim 6, wherein the pressure equalizer comprises:

a first rod coupled to a first side of the actuator and the first valve; and a second rod coupled to a second side of the actuator and the second valve.

8. The downhole tool according to claim 1, further comprising:

a focused sampling module.

9. The downhole tool according to claim 8, further comprising:

a fluid analyzer module.

10. The downhole tool according to claim 9, wherein the pressure equalizer is configured between the focused sampling module and the fluid analyzer module.

* * * * *